United States Patent [19]

Tarleton

[11] Patent Number: 4,878,620

[45] Date of Patent: Nov. 7, 1989

[54] ROTARY VANE NOZZLE

[76] Inventor: E. Russell Tarleton, 13805 23rd Ave. SE, Bothell, Wash. 98012

[21] Appl. No.: 200,012

[22] Filed: May 27, 1988

[51] Int. Cl.[4] ..... B05B 1/34; F24F 7/00

[52] U.S. Cl. ..... 239/383; 98/40.3

[58] Field of Search ..... 239/380–389; 415/125, 146; 98/40.3

[56] References Cited

U.S. PATENT DOCUMENTS

| | | | |
|---|---|---|---|
| 1,244,480 | 10/1917 | Dieterich . | |
| 1,589,010 | 6/1926 | Lallemand | 415/146 X |
| 1,957,307 | 5/1934 | Ohlsen | 239/380 X |
| 4,350,472 | 9/1982 | Morimoto | 415/125 |
| 4,521,153 | 6/1985 | Morimoto et al. | 415/146 |
| 4,616,563 | 10/1986 | Toohey | 98/40.3 |
| 4,632,021 | 12/1986 | Bolton et al. | 98/40.3 |
| 4,743,739 | 5/1988 | Tateishi | 415/125 X |

FOREIGN PATENT DOCUMENTS

| | | | |
|---|---|---|---|
| 2074239 | 10/1981 | United Kingdom | 415/146 |

*Primary Examiner*—Andres Kashnikow
*Assistant Examiner*—Patrick N. Burkhart

[57] ABSTRACT

A rotary vane nozzle 10 having a rotary vane member (12) rotatably mounted to a stationary vane member (14). The rotary vane member (12) includes a plurality of vanes (20) for directing the flow of air (50) in a first plane oblique to the X axis. A propeller vane (22) formed on the rotary vane member (12) reacts to the force of the airflow (50) to rotate the rotary vane member (12) to thereby rotate the first plane of airflow about the X axis. As the rotating airflow passes through the stationary vane member (14) the airflow 50 is directed into a second plane to laterally reciprocate in the second plane of airflow.

21 Claims, 3 Drawing Sheets

ROTARY VANE NOZZLE

TECHNICAL FIELD OF THE INVENTION

The present invention relates to devices for directing fluid flow, and, more particularly, to a rotary vane nozzle for continuously redirecting the flow of fluid in a predetermined pattern.

BACKGROUND OF THE INVENTION

While the present invention was developed for use with forced airflow, and it is described in this context, it is to be understood that the invention can be used in any fluid flow apparatus, such as water jets, shower heads, etc. Consequently, the invention is not limited to the context in which it is described herein.

Devices utilizing forced airflow, such as fans, air conditioners, heaters, hair dryers and the like, typically have an opening or nozzle through which the flowing stream of air passes as it exits the device. The stream of air can be directed to flow in a predetermined direction by the selective orientation of the nozzle walls. Alternatively, vanes may be mounted on the nozzle walls to deflect the flow in the desired direction. The direction of airflow can be altered by repositioning the nozzle or vanes. This requires an operator to either manually reposition the nozzle and vanes or activate a motor-driven apparatus to effect mechanical repositioning.

In some applications it is desirable or necessary to continuously redirect the flow of air in a predetermined pattern, such as a back-and-forth waving motion. The manual and mechanical repositioning methods described above have numerous drawbacks that render them unsuitable for these applications.

First, manual repositioning of nozzles and vanes would require continuous effort on the part of an operator. This can be tiring to the operator and economically unfeasible in the commercial environment Second, with mechanically powered nozzles and vanes, additional power would be needed to energize a drive motor. Furthermore, such a mechanical device would require a number of moving parts to accomplish even a simple reciprocating motion of the nozzle or vanes, which adds cost as well as complexity to a commercial product. In addition, a motor-driven nozzle would be unfeasible for use on hand-held devices because of the added weight that an operator would have to hold.

Finally, none of these methods would be capable of directing airflow to create a pulse effect, i.e., continual discharge of periodic bursts of airflow. Although a pulsing airflow may be accomplished by repeatedly blocking the flow of air, this would be dangerous in devices utilizing hot air because it would cause a build up of air pressure and overheating. Consequently, there is a need for a simple, lightweight nozzle that operates off the existing airflow to continuously redirect the stream of airflow in a predetermined pattern.

SUMMARY OF THE INVENTION

In accordance with the present invention, a nozzle for continuously redirecting the flow of fluid in a predetermined pattern is provided. The nozzle, positioned in a stream of fluid flowing along a longitudinal axis, includes a rotary vane member for directing fluid flow in a first plane oblique to the longitudinal axis; rotating means for rotating the rotary vane member about a rotational axis to thereby rotate the first plane of fluid flow about the rotational axis; and a stationary vane member positioned downstream from said rotary vane member to direct the rotating plane of fluid to flow in a third plane such that the flow of fluid is continuously redirected to laterally reciprocate in said third plane.

In accordance with another aspect of the present invention, the rotating means comprises a propeller means integrally formed with the rotary vane member that reacts to the force of the fluid to rotate the rotary vane member.

In accordance with yet another aspect of the present invention, a control means, preferably in the form of an adjustable friction lever bearing on an outer circular rim of the rotary vane member, acts to brake the rotational speed of the rotary vane member.

In accordance with yet another aspect of the present invention, the nozzle comprises a rotary vane member for dividing fluid flow into a first plane oblique to the longitudinal axis and a second plane oblique to the longitudinal axis; rotating means, preferably in the form of a propeller means formed integrally with the rotary vane member, to rotate the rotary vane member about a rotational axis to thereby rotate the first and second planes of fluid flow about the rotational axis; and a stationary vane member positioned downstream from the rotary vane member to direct the first and second planes of fluid to flow in a third plane such that the fluid flow from the first and second planes laterally reciprocate in the third plane to periodically overlap and combine to achieve a pulse-effect discharge.

As will be readily appreciated from the foregoing description, the present invention provides a continuously redirecting nozzle that requires no additional power. Rather, the nozzle utilizes a rotary vane member that operates off the flow of the fluid to redirect the fluid flow in either a wave motion, i.e., a back and forth motion, or a pulse-effect discharge, i.e., the periodic dividing and then recombining of the fluid flow. The resultant nozzle is lightweight, thus making it suitable for hand-held devices such as hair dryers. In addition, the present invention requires no complex moving parts or additional motors. As a result, it will be useful in heaters, air conditioners, wall mounted hair dryers and the like, where it is desirable to continuously redirect the flow of fluid, such as air, in a predetermined pattern.

BRIEF DESCRIPTION OF THE DRAWINGS

The foregoing features and advantages of the present invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
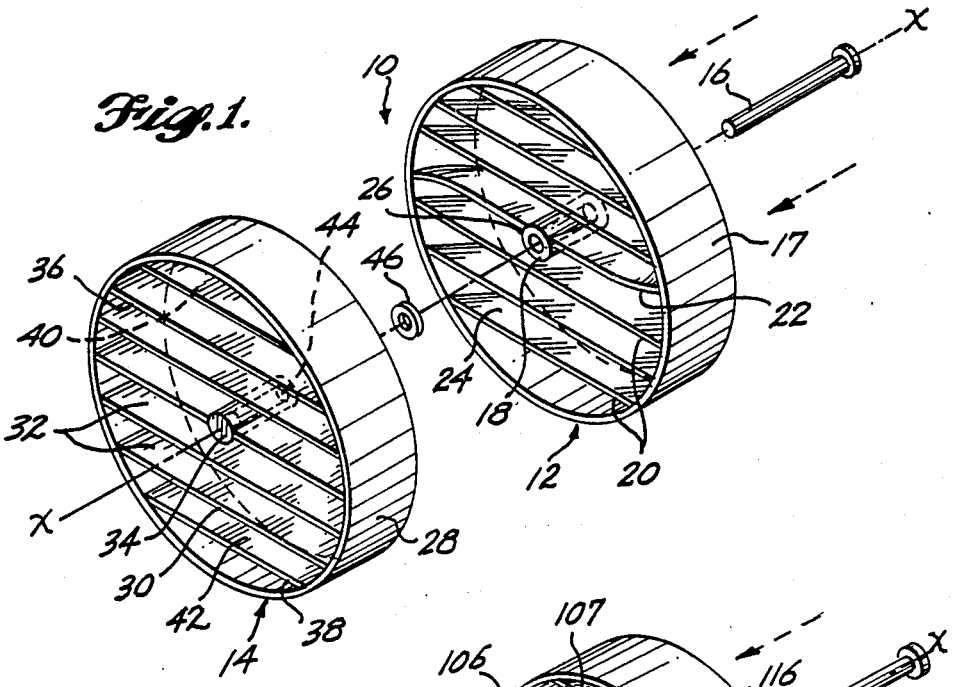
FIG. 1 is an exploded isometric view of the rotary vane nozzle formed in accordance with the present invention.

Referring initially to FIG. 1, the rotary vane nozzle 10 includes a rotary vane member 12, a stationary vane member 14, and an axle pin 16. The rotary vane member 12 and the stationary vane member 14 are shown having a circular cross-sectional shape when viewed along the longitudinal axis X—X. However, it is to be understood that they may take other cross-sectional shapes as required to meet the needs of their intended use.

The rotary vane member 12 includes a circular frame 17, a central hub 18, a plurality of deflecting vanes 20, and a propeller vane 22. Each of the deflecting vanes 20 is integrally formed with the circular frame 17 and are oriented to be coplanar with one another. As illustrated in the preferred embodiment, the vanes 20 are initially formed to have their planar faces 24 oriented oblique to the X axis and preferably at an angle of 15° with respect to the X axis, as illustrated in FIG. 2B.

The propeller vane 22 is formed to have each end twisted in an opposite direction with respect to the other end. In this configuration, the propeller vane 22 reacts to the force of air flowing through the rotary vane member 12 and causes the rotary vane member 12 to rotate about a rotational axis, in this case the X axis. Alternatively, the propeller vane 22 may have an oppositely-oriented airfoil shape at each end to induce rotation in response to the flow of air.

Centrally located on the propeller vane 22 is the hub 18 having an opening 26 on the upstream side through which passes the axle pin 16 As such, the rotary vane member 12 is supported on and rotates about the axel pin 16.

The stationary vane member 14 is constructed of a circular frame member 28, a plurality of vanes 30 having planar faces 32 on each side, and a central hub 34. The vanes 30 are integrally formed with the circular frame 28 and have their faces 32 orientated coplanar with each other and substantially parallel to the X axis. In order to insure the flow of air passing through the vanes 30 is directed parallel to the X axis, the top vane 36 and the bottom vane 38 are inclined toward the X axis such that air passing through the rotary vane member 12 impacts the inclined planar faces 40 and 42 to be directed towards the X axis, as is more clearly shown in FIG. 2A.

The central hub 34 is provided with an opening 44 in the upstream end to receive the axle pin 16. When the rotary vane nozzle 10 is assembled, the axle pin 16 is passed through the rotary vane member 12 and is either threaded or press-fit into the opening 44 in the hub 34 of the stationary vane member 14. In order to reduce friction and wear, a thrust washer 46 is placed on the axel pin 16 between the rotary vane member 12 and the stationary vane member 14.

In the preferred embodiment, the stationary vane member 14 is fixedly mounted to a structural member, while the rotary vane member 12, positioned adjacent to and upstream from the stationary vane member 14, rotates about the axle pin 16 that is affixed to the stationary vane member 14. Air flowing through the rotary vane member 12 impacts on the propeller vane 22, causing the rotary vane member 12 to rotate either in a clockwise or counter clockwise direction, depending on the direction of twist of the propeller vane 22.

In operation, airflow impacting the deflecting vane faces 24 of the rotary vane member 12 is deflected into a single plane oblique to the axis of the airflow, in this case the X-axis. The propeller 22, reacting to the force of the airflow, rotates the rotary vane member 12 to thereby rotate the plane of airflow about the rotational axis defined by the axle pin 16. This rotating plane of air then passes through the stationary vane member 14. When the air impacts the vane faces 32, 40 and 42 of the stationary vane member 14, it is deflected into a second plane. In the preferred embodiment, this second plane is parallel to the X-axis. However, the stationary vane member 14 may be positioned such that the second plane of airflow is oblique to the X-axis. As the rotary vane member 12 rotates, the airflow will laterally reciprocate in the second plane as directed by the stationary vanes 30, 36 and 38.

Figure 2A:
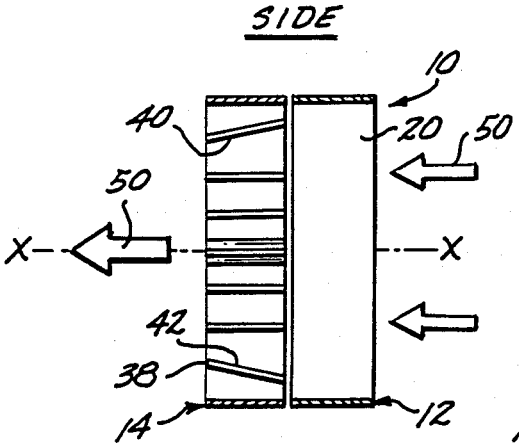
FIGS. 2A–F are a series of cross-sectional side and top views illustrating the operation of the rotary vane nozzle of FIG. 1.
Figure 2B:
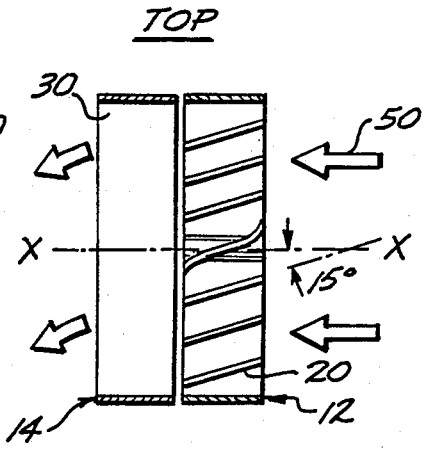

This is more clearly depicted in FIGS. 2A–F, a series of cross-sectional views showing the airflow path as it passes through the nozzle 10. FIGS. 2A–B are cross-sectional side and top views respectively of the nozzle 10 with the rotary vane member 12 having the deflecting vanes 20 vertically positioned. As such, the air 50 flowing along the longitudinal axis X—X passes through the rotary vane member 12 to the deflected by the vanes 20 in a single plane to the left, as shown in FIG. 2B. Because the stationary vanes 30 are positioned at a right angle to or lie transverse to the airflow at this point, the air 50 meets no resistance and flows in the single plane directed to the left of the X axis.

Figure 2C:
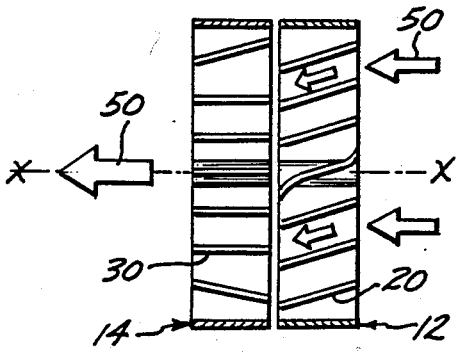

In FIG. 2C, the rotary vane member 12 has rotated 90° so that the deflecting vanes 20 are now substantially in a horizontal position with the vane faces 24 oriented to deflect the single plane of air 50 downward. However, as the air 50 passes through the stationary vane member 14 it is deflected to the second plane, in this case back to the original direction of airflow along the X axis. The net effect is that the air 50 continues to flow in the same vertical direction; however, in the top view shown in FIG. 2D, it can be seen that the second plane of air 50 has now changed horizontal directions to flow substantially parallel to the X axis.

Figure 2D:
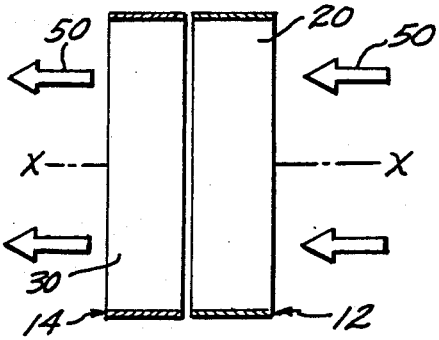
Figure 2E:
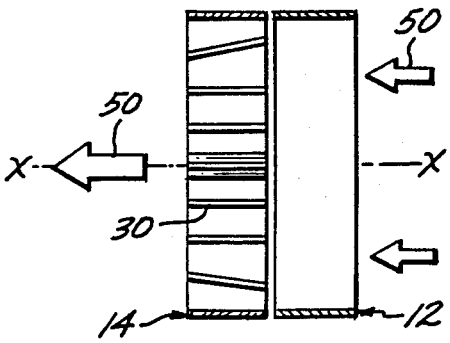
Figure 2F:
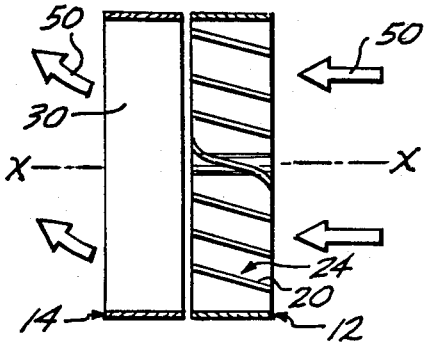

Finally, in FIGS. 2E–F the rotary vane member 12 has rotated another 90° in the same direction so that the deflecting vanes 20 are substantially vertical, and the vane faces 24 are oriented to deflect the flow of air 50 to the right of the X axis, as shown more clearly in the top view of FIG. 2F. In this configuration, the air 50 meets no resistance from the stationary vanes 30 of the stationary vane member 14 because the stationary vanes 30 are transverse to and substantially coplanar with the airflow.

Thus, when the flow of air 50 is viewed from the side, as depicted in FIGS. 2A, 2C and 2E, the vertical direction of the airflow is unchanged. However, when the flow of air 50 is viewed from the top, as depicted in FIGS. 2B, 2D and 2F, it can be seen that the flow of air 50 continuously changes direction by laterally reciprocating with respect to the X axis as the vane member 12 rotates. The degree of deviation of airflow from the x axis is determined by the angular position of the deflecting vanes 20 on the rotary vane 14. Ideally, the airflow will be deflected approximately 15° from the X axis to give an adequate coverage area with dispersing the air too much. This is subject, of course, to the particular needs of the application. In addition, it will be appreciated that although the flow of air has been depicted to laterally reciprocate in a horizontal direction, the stationary vane member 14 may be rotated 90° to have the air laterally reciprocate in a vertical direction. For that matter, the stationary vane member 14 may be mounted at any desired position to change the orientation of lateral reciprocation.

Figure 3:
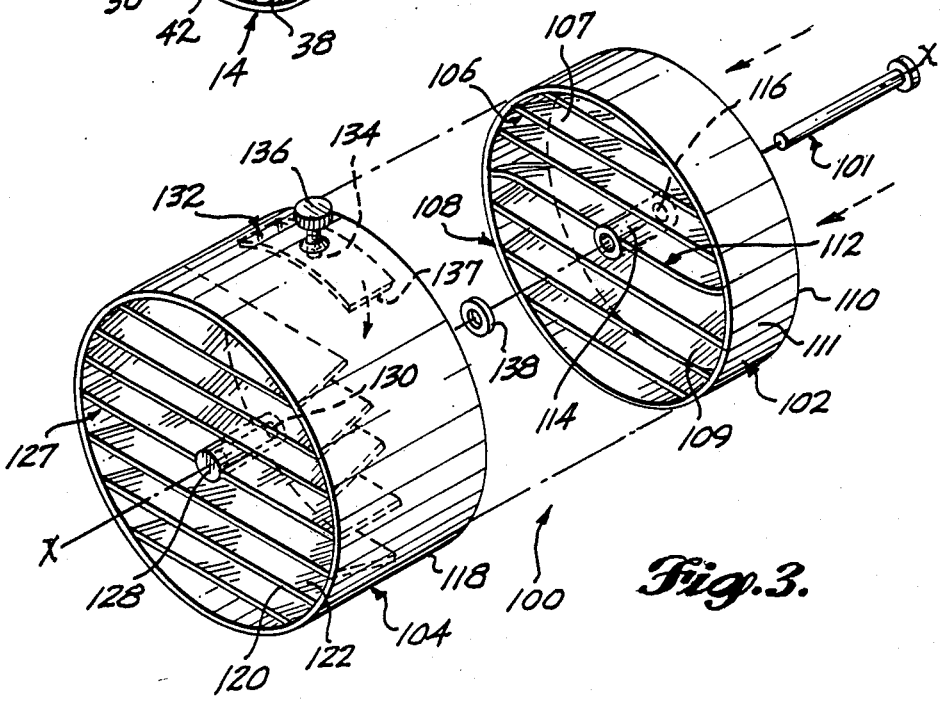
FIG. 3 is an exploded isometric view of an alternative embodiment of the rotary vane nozzle formed in accordance with the invention.

FIG. 3 illustrates an alternative embodiment of the invention, wherein the rotary vane nozzle 100 includes a rotary vane member 102, an axle pin 101 and a stationary vane member 104. The rotary vane member 102 includes a cylindrical frame 110 having a substantially smooth outer face 111 circumscribing a plurality of deflecting vanes. The vanes include a first set of vanes 106 having faces 107 on each side that are oriented to angle upward and away from the X axis and a second set of vanes 108 having faces 109 on each side that are oriented to angle downward and away from the X axis. Preferably both sets of vanes are angled at 15° with respect to the X axis. When the flow of air impacts the vane faces 107 of the first set of vanes 106, the airflow will be directed or deflected into a first plane oblique to the X axis. In addition, when the airflow impacts the vane faces 109 of the second set of vanes 108, the airflow will be deflected downward and away from the X axis. Thus, when the airflow meets the rotary vane member 102, it will be divided into two planes of airflow that are oblique to the X axis. In the preferred embodiment, the two planes of airflow will diverge from each other at an angle of 30°.

The rotary vane member 102 also includes a propeller vane 112 having oppositely twisted ends to react to the force of the airflow to rotate the rotary vane member 102. Alternatively, the propeller vane 112 may have oppositely oriented airfoil shaped ends to induce rotation in response to the flow of air. Centrally located on the propeller vane 112 is a hub 114 having an opening 116 sized to slidably receive the axle pin 101.

The stationary vane member 104 comprises a cylindrical wall 118 having a plurality of stationary vanes 120 preferably integrally formed on the inside thereof. The wall 118 may be a portion of a larger shell that houses the source of the airflow, such as a hairdryer. The stationary vanes 120 have substantially planar faces 122 on each side that are oriented to angle towards the X axis. When the flow of air impacts the vane faces 122, it will be directed to flow substantially parallel to the X axis. Centrally located on the middle vane 127 is a hub 128 having an opening 130 sized to receive the axle pin 101.

Also mounted on the walls of the stationary vane member 104 is a control device 132 for controlling the rotational speed of the rotary vane member 102. The control device 132 consists of a paddle 134 formed of spring steel and pivotally mounted at one end to the cylindrical wall 118. A threadably mounted adjusting knob 136 mounted on the outside of the cylindrical wall 118 is turned to apply pressure on the paddle 134. The paddle 134 in turn applies pressure to the outer surface 111 of the rotary vane member 102 to act as a brake and slow the rotation thereof.

When the rotary vane member 102 is mounted to the stationary vane member 104, the axle pin 101 will pass through the opening 116 and the hub 114 of the rotary vane member 102 and be either threadably engaged or press-fit in the hub 128 of the stationary vane member 104. A thrust washer 138 is preferably positioned on the axel pin 101 between the rotary vane member 102 and the stationary vane member 104 to reduce friction and wear between the moving parts.

When so assembled, the paddle 134 of the control device 132 will bear on the outer face 111 of the frame 110 on the rotatable vane member 102. By turning the knob 134, the free end 137 of the paddle 134 will apply more pressure to the face 111 to slow the rotation of the rotary vane member 102. In like manner, the knob 136 may be backed out of the wall 118 to release pressure on the paddle 134 and allow the free end 137 of the paddle 134 to lightly rest on the outer face 111 of the rotatable vane member to allow the rotary vane member 102 to rotate at a faster speed. The maximum speed of rotation will be determined by the amount of twist or camben of the ends of the propeller vane 112.

When the rotary vane member 102 is rotated, the first and second planes of airflow will be rotated about the rotational axis, in this case the X axis. However, as the rotating planes of airflow impact on the inclined planar faces 122 of the stationary vanes 120, each of the rotating planes of airflow will be directed into a third plane as defined by the orientation of the stationary vanes 120. In this case, the planar faces 122 of the vanes are inclined towards the X axis, and thus the third plane of airflow will meet and be substantially parallel to the X axis. As the rotary vane member 102 rotates, the first and second rotating planes of airflow will be caused to laterally reciprocate in the third plane of airflow. However, the rotating planes of airflow will periodically overlap to reunite the divided airflow into a combined airflow. The periodic overlapping of the two planes of airflow in the single third plane to form a combined airflow achieves an effect similar to pulsing airflow, i.e., the periodic starting and stopping of a stream of air. The present invention provides a way of achieving a pulse effect without having to periodically start and stop the flow of air.

Figure 4A:
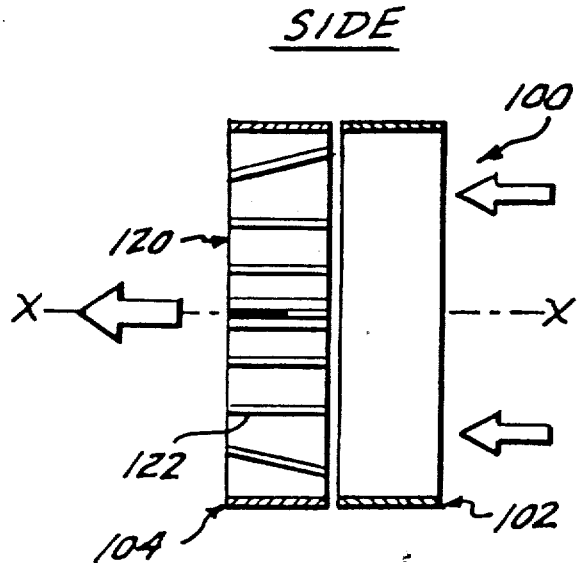
FIGS. 4 A–D are a series of cross-sectional side and top views illustrating the operation of the rotary vane nozzle of FIG. 3.
Figure 4B:
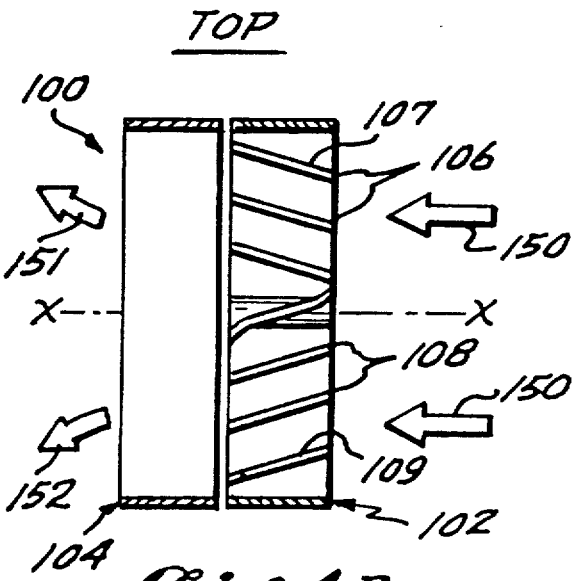

The operation of the rotary vane member 102 in combination with the stationary vane member 104 can be more clearly understood when reference is had to FIGS. 4A–D. In FIG. 4A, the rotary vane member 100 is positioned so that the deflecting vane faces 109 are oriented substantially vertical with respect to the X axis. The stationary vane member 104 is positioned so that the planar faces 122 of the stationary vanes 120 are horizontal and inclined toward the X axis. Referring to FIG. 4B, when the rotary vane member 102 is rotationally positioned as shown, the first set of vanes 106 and the second set of vanes 108 will be oriented so that the vane faces 107 and 109 direct the air 150 to flow into two planes, a first plane 151 directed to the right of the X axis and a second plane !52 directed to the left of the X axis. Because the stationary vanes 120 are transverse to the first and second planes of airflow and the second plane of airflow, the air will meet little resistance and be disbursed in the two lateral directions within a single third plane 153.

Figure 4C:
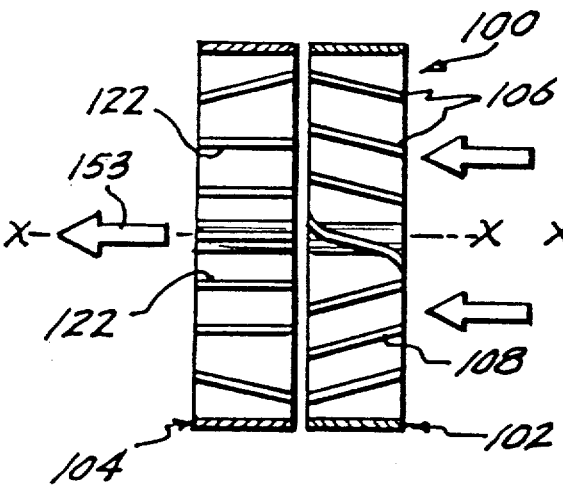
Figure 4D:
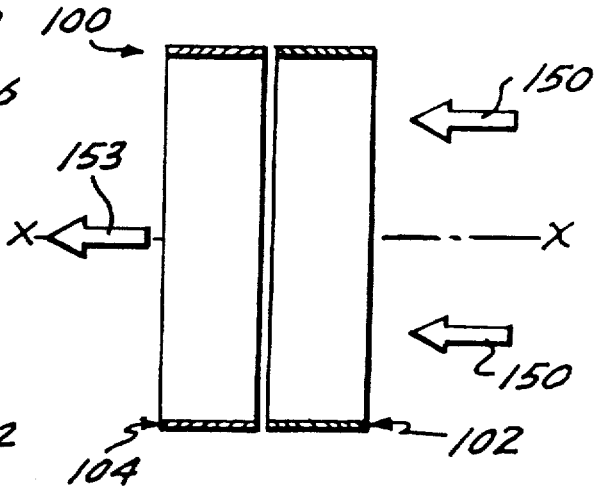

FIGS. 4C–D depict the rotary vane member 102 as it has been rotated 90° about the axis. In this position, the first set of vanes 106 and the second set of vanes 108 are now directing the first and second planes of air 151 and 152 above and below the X axis respectively. However, the air will impact the planar faces 122 of the stationary vanes 120, and be redirected back into the third plane of flowing air 153 that is substantially parallel to the X axis. As shown in FIG. 4D, the first and second planes of airflow 151 and 152 are directed by the stationary vanes 120 to overlap and be directed along a combined path of flowing air 153. This overlapping effect occurs every 180° of rotation of the rotary vane member 102 to achieve two pulses of combined airflow per one rotation of the rotary vane member 102.

Preferably, both the rotary vane member and the stationary vane member are constructed of molded polyurethane. This will keep the nozzle light while at the same time providing a tough, heat resistant bearing surface suitable for use in heaters, air conditioners, water jets and the like. Ideally, the axle pin will be a hardened steel having a plated or polished surface to provide low resistance to the rotatable vane member. In addition, the paddle of the control device is preferably constructed of light weight resilient material such as spring steel that is resistant to wear while being somewhat flexible.

While a preferred embodiment of the invention has been illustrated and described, it will be appreciated that various changes can be made therein without departing from the spirit and scope of the invention. For instance, the rotational speed of the rotary member can be varied by having bendable propeller vanes that permit adjustment of the vane twist. In addition, other well-known methods may be used to alter the rotational speed of the rotary vane member. Furthermore, the stationary vane member can be formed without the vanes, wherein the clylindrical wall 118 has the exit opening necked down into an oblong or rectangular cross-sectional shape to direct the rotating plane or planes of airflow into a single plane. Finally, the stationary vane member 104 can be rotated while the rotary vane member 102 is held stationary to achieve the pulse effect airflow. In this case the propeller vane would be located on the stationary vane member 104. Alternatively, both vane members 102 and 104 maybe counter rotated, or rotated at different speeds in the same direction, to achieve a pulse effect. Consequently, the invention can be practiced otherwise than as specifically described herein.

The embodiments of the invention in which an exclusive property or privilege is claimed are defined as follows:

1. A nozzle for continuously redirecting the entire volume of a flow of fluid in a predetermined pattern, the fluid flowing along a longitudinal axis, the nozzle comprising:

a continuously rotating first fluid directing means for directing the entire volume of the fluid to flow in a first plane oblique to the longitudinal axis;

means for continuously rotating the first fluid directing means about a rotational axis to thereby rotate the plane of flowing fluid about the rotational axis; and a second fluid directing means for directing the rotating plane of flowing fluid into a second plane such that the entire volume of the fluid flow continuously laterally reciprocates in said second plane.

2. The nozzle of claim 1, wherein said second fluid directing means is positioned downstream from said first fluid directing means and is stationary with respect to said rotating first fluid directing means.

3. The nozzle of claim 2, wherein said first fluid directing means comprises one or more vanes oriented at a predetermined angle with respect to the longitudinal axis.

4. The nozzle of claim 3, wherein said second fluid directing means comprises one or more vanes oriented at predetermined angle with respect to the longitudinal axis.

5. The nozzle of claim 4, wherein said rotating means comprises a propeller means attached to said first fluid directing means that reacts to the flowing fluid to thereby rotate said first fluid directing means.

6. The nozzle of claim 5, wherein said first fluid directing means is rotatably mounted to said second fluid directing means.

7. The nozzle of claim 5, further the comprising means for controlling the rate of rotation of said first fluid directing means.

8. The nozzle of claim 7, wherein said control means comprises an adjustable paddle that bears against said first fluid directing means.

9. The nozzle of claim 4, wherein said rotating means comprises a motor means for rotating said first fluid directing means.

10. A nozzle for continuously redirecting the entire volume of a flow of fluid in a predetermined pattern, the first flowing along a longitudinal axis, the nozzle comprising:

a rotatable fluid directing means having a first vane means configured to direct a first portion of the entire volume of the fluid flow into a first plane oblique to the longitudinal axis and a second vane means configured to direct a second portion of the fluid in a second plane oblique to the longitudinal axis, said second portion comprising the balance of the entire volume of fluid flow not directed into said first plane;

rotating means for continuously rotating the rotatable fluid directing means about a rotational axis to thereby rotate the first plane and second plane of fluid flow about the rotational axis; and a stationary fluid directing means located downstream from said rotatable fluid directing means, said stationary fluid directing means configured to direct the first rotating plane of fluid flow and the second rotating palen of fluid flow in to a third plane such that the first plane of fluid flow and the second plane of fluid flow laterally reciprocate in said third plane of fluid flow to periodically overlap and combine the entire volume of fluid flow in a single plane to thereby achieve a pulsing fluid flow.

11. The nozzle of claim 10, wherein said stationary fluid directing means comprises a plurality of vanes.

12. The nozzle of claim 11, wherein said rotating means comprises a motor means coupled coupled to said rotatable fluid directing means.

13. The nozzle of claim 11, wherein said rotating means comprises a propeller means attached to said rotatable fluid directing means to react to the flow of fluid to thereby rotate said rotatable fluid directing means.

14. The nozzle of claim 13, wherein said rotatable fluid directing means is rotatably mounted to said stationary fluid directing means.

15. The nozzle of claim 11, further comprising means for controlling the rate of rotation of said rotatable air directing means.

16. The nozzle of claim 15, wherein said control means comprises an adjustable paddle that bears against said rotatable fluid directing means.

17. The nozzle of claim 11, further comprising wall means attached to said stationary fluid directing means to further confine and direct the fluid flow.

18. The nozzle of claim 17, wherein said stationary fluid directing means is integrally formed with the wall means.

19. A nozzle for continuously redirecting the entire volume of a flow of fluid in a predetermined pattern, the fluid flowing along a first axis, the nozzle comprising: a first means for deflecting the entire volume of the fluid to flow into one or more planes of fluid flow oblique to the first axis; a second means positioned adjacent to and downstream from said first means for deflecting said one or more planes of fluid flow into a single plane of flowing fluid; and means for continuously rotating one or the other or both of said first and second deflecting means such that the one or more planes of the entire volume of flowing fluid laterally reciprocate in the single plane of fluid flow.

20. The nozzle of claim 19, wherein said rotating means comprises a propeller means integrally formed with said first or second or both deflecting means.

21. The nozzle of claim 20, further comprising means for controlling the rate of rotation of one or the other or both of said deflecting means.

* * * * *

UNITED STATES PATENT AND TRADEMARK OFFICE

CERTIFICATE OF CORRECTION

PATENT NO. : 4,878,620

DATED : November 7, 1989

INVENTOR(S) : E. Russell Tarleton

It is certified that error appears in the above-identified patent and that said Letters Patent is hereby corrected as shown below:

Column 1, line 38, insert --.-- after "environment"
Column 3, line 32, insert --.-- after "16"
Column 3, line 33, "axel" should be --axle--
Column 3, line 54, "axel" should be --axle--
Column 4, line 23, "the" (second occurrence) should be --be--
Column 4, line 60, "14" should be --12--
Column 4, line 62, "with" should be --without--
Column 5, line 39, "hairdryer" should be --hair dryer--
Column 5, line 64, "axel" should be --axle--
Column 6, line 2, "134" should be --136--
Column 6, line 10, "camben" should be --camber--
Column 6, line 37, "100" should be --102--
Column 6, line 48, "!52" should be --152--
Column 6, line 52, "disbursed" should be --dispersed--
Column 8, line 36, "palen" should be --plane--
Column 8, line 36, "in to" should be --into--
Column 7, line 65, insert --a-- before "predetermined"
Column 8, line 6, "the comprising" should be --comprising the--
Column 8, line 47, delete --coupled-- after "means"

The sheet of drawings, consisting of Figs. 4A-4D, should be added as shown on the attached sheet.

Signed and Sealed this

Twenty-eighth Day of May, 1991

*Attest:*

HARRY F. MANBECK, JR.

*Attesting Officer*

*Commissioner of Patents and Trademarks*